US006421217B1

(12) United States Patent
Castonguay et al.

(10) Patent No.: US 6,421,217 B1
(45) **Date of Patent: *Jul. 16, 2002**

(54) CIRCUIT BREAKER ACCESSORY RESET SYSTEM

(75) Inventors: Roger N. Castonguay, Terryville; James L. Rosen, West Hartford, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/526,945

(22) Filed: Mar. 16, 2000

(51) Int. Cl.[7] ..... H01H 73/00
(52) U.S. Cl. ..... 361/115
(58) Field of Search ..... 361/115; 335/6, 335/172

(56) References Cited

U.S. PATENT DOCUMENTS

| | | | | |
|---|---|---|---|---|
| 2,340,682 | A | 2/1944 | Powell | 218/25 |
| 2,719,203 | A | 9/1955 | Gelzheiser et al. | 200/275 |
| 2,937,254 | A | 5/1960 | Ericson | 337/11 |
| 3,158,717 | A | 11/1964 | Jencks et al. | 200/337 |
| 3,162,739 | A | 12/1964 | Klein et al. | 335/9 |
| 3,197,582 | A | 7/1965 | Norden | 200/50.1 |
| 3,307,002 | A | 2/1967 | Cooper | 337/7 |
| 3,517,356 | A | 6/1970 | Hanafusa | 335/16 |
| 3,631,369 | A | 12/1971 | Menocal | 337/110 |
| 3,803,455 | A | 4/1974 | Willard | 361/106 |
| 3,883,781 | A | 5/1975 | Cotton | 361/37 |
| 4,129,762 | A | 12/1978 | Bruchet | 200/401 |
| 4,144,513 | A | 3/1979 | Shaffer et al. | 335/46 |
| 4,158,119 | A | 6/1979 | Krakik | 200/240 |
| 4,165,453 | A | 8/1979 | Hennemann | 200/401 |
| 4,166,988 | A | 9/1979 | Ciarcia et al. | 335/9 |
| 4,220,934 | A | 9/1980 | Wafer et al. | 335/16 |
| 4,255,732 | A | 3/1981 | Wafer et al. | 335/16 |
| 4,259,651 | A | 3/1981 | Yamat | 335/16 |
| 4,263,492 | A | 4/1981 | Maier et al. | 200/288 |
| 4,276,527 | A | 6/1981 | Gerbert-Gaillard et al. | 335/39 |
| 4,297,663 | A | 10/1981 | Seymour et al. | 335/20 |
| 4,301,342 | A | 11/1981 | Castonguay et al. | 200/400 |
| 4,360,852 | A | 11/1982 | Gilmore | 361/98 |
| 4,368,444 | A | 1/1983 | Preuss et al. | 335/166 |
| 4,375,021 | A | 2/1983 | Pardini et al. | 218/25 |
| 4,375,022 | A | 2/1983 | Daussin et al. | 218/43 |
| 4,376,270 | A | 3/1983 | Staffen | 335/21 |
| 4,383,146 | A | 5/1983 | Bur | 200/17 R |
| 4,392,036 | A | 7/1983 | Troebel et al. | 200/322 |
| 4,393,283 | A | 7/1983 | Masuda | 200/51.09 |
| 4,401,872 | A | 8/1983 | Boichot-Castagne et al. | 200/401 |
| 4,409,573 | A | 10/1983 | DiMarco et al. | 335/16 |
| 4,435,690 | A | 3/1984 | Link et al. | 335/37 |

(List continued on next page.)

FOREIGN PATENT DOCUMENTS

GB 002294811 * 11/1994

*Primary Examiner*—Adolf Deneke Berhane
*Assistant Examiner*—Pia Tibbits
(74) *Attorney, Agent, or Firm*—Cantor Colburn LLP

(57) ABSTRACT

An accessory includes a trip arm biased by a spring to pivot in a clockwise direction about a trip arm pivot. A latch is arranged to pivot about a latch pivot and has the trip arm acting on a latch surface on the latch to bias the latch in a counter clockwise direction about the latch pivot. An electromechanical device including a plunger acts on the latch pulling it clockwise about the latch pivot. When a signal is provided to the electromechanical device, the plunger is released allowing the trip arm to pivot clockwise about the trip arm pivot due to the spring and actuates the operating mechanism. To reset the trip arm and the latch, a reset lever is arranged to pivot about the latch pivot. The reset lever includes a tab portion configured for interfacing the operating mechanism, and a drive portion for interfacing the trip arm. This, when the operating mechanism is reset, a portion extending from an operating handle interfaces the tab portion to pivot the reset lever clockwise about the latch pivot. The drive portion interfaces the trip arm to drive the trip arm counterclockwise about the trip arm pivot.

20 Claims, 12 Drawing Sheets

U.S. PATENT DOCUMENTS

| | | | | |
|---|---|---|---|---|
| 4,467,297 | A | 8/1984 | Boichot-Castagne et al. | 335/8 |
| 4,468,645 | A | 8/1984 | Gerbert-Gaillard et al. | 335/42 |
| 4,470,027 | A | 9/1984 | Link et al. | 335/16 |
| 4,479,143 | A | 10/1984 | Watanabe et al. | 348/276 |
| 4,488,133 | A | 12/1984 | McClellan et al. | 335/16 |
| 4,492,941 | A | 1/1985 | Nagel | 335/13 |
| 4,541,032 | A | 9/1985 | Schwab | 361/600 |
| 4,546,224 | A | 10/1985 | Mostosi | 200/401 |
| 4,550,360 | A | 10/1985 | Dougherty | 361/93.2 |
| 4,562,419 | A | 12/1985 | Preuss et al. | 335/195 |
| 4,589,052 | A | 5/1986 | Dougherty | 361/94 |
| 4,595,812 | A | 6/1986 | Tamaru et al. | 200/307 |
| 4,611,187 | A | 9/1986 | Banfi | 335/16 |
| 4,612,430 | A | 9/1986 | Sloan et al. | 200/327 |
| 4,616,198 | A | 10/1986 | Pardini | 335/16 |
| 4,622,444 | A | 11/1986 | Kandatsu et al. | 200/303 |
| 4,631,625 | A | 12/1986 | Alexander et al. | 361/94 |
| 4,642,431 | A | 2/1987 | Tedesco et al. | 200/401 |
| 4,644,438 | A | 2/1987 | Puccinelli et al. | 361/75 |
| 4,649,247 | A | 3/1987 | Preuss et al. | 200/244 |
| 4,658,322 | A | 4/1987 | Rivera | 361/37 |
| 4,672,501 | A | 6/1987 | Bilac et al. | 361/96 |
| 4,675,481 | A | 6/1987 | Markowski et al. | 200/1 |
| 4,682,264 | A | 7/1987 | Demeyer | 361/96 |
| 4,689,712 | A | 8/1987 | Demeyer | 361/96 |
| 4,694,373 | A | 9/1987 | Demeyer | 361/96 |
| 4,710,845 | A | 12/1987 | Demeyer | 361/96 |
| 4,717,985 | A | 1/1988 | Demeyer | 361/96 |
| 4,733,211 | A | 3/1988 | Castonguay et al. | 335/192 |
| 4,733,321 | A | 3/1988 | Lindeperg | 361/96 |
| 4,764,650 | A | 8/1988 | Bur et al. | 200/153 G |
| 4,768,007 | A | 8/1988 | Mertz et al. | 335/202 |
| 4,780,786 | A | 10/1988 | Weynachter et al. | 361/87 |
| 4,831,221 | A | 5/1989 | Yu et al. | 200/553 |
| 4,870,531 | A | 9/1989 | Danek | 361/93.1 |
| 4,883,931 | A | 11/1989 | Batteux et al. | 218/46 |
| 4,884,047 | A | 11/1989 | Baginski et al. | 361/634 |
| 4,884,164 | A | 11/1989 | Dziura et al. | 361/97 |
| 4,900,882 | A | 2/1990 | Bernard et al. | 218/26 |
| 4,910,485 | A | 3/1990 | Bolongeat-Mobleu et al. | 335/195 |
| 4,914,541 | A | 4/1990 | Tripodi et al. | 361/94 |
| 4,916,420 | A | 4/1990 | Bartolo et al. | 335/172 |
| 4,916,421 | A | 4/1990 | Pardini et al. | 335/185 |
| 4,926,282 | A | 5/1990 | McGhie | 361/102 |
| 4,935,590 | A | 6/1990 | Malkin et al. | 218/57 |
| 4,937,706 | A | 6/1990 | Schueller et al. | 361/744 |
| 4,939,492 | A | 7/1990 | Raso et al. | 335/42 |
| 4,943,691 | A | 7/1990 | Mertz et al. | 218/117 |
| 4,943,888 | A | 7/1990 | Jacob et al. | 361/96 |
| 4,950,855 | A | 8/1990 | Bolonegeat-Mobleu et al. | 218/66 |
| 4,951,019 | A | 8/1990 | Gula | 335/166 |
| 4,952,897 | A | 8/1990 | Barnel et al. | 335/147 |
| 4,958,135 | A | 9/1990 | Baginski et al. | 361/673 |
| 4,965,543 | A | 10/1990 | Batteux | 335/174 |
| 4,983,788 | A | 1/1991 | Pardini | 200/16 R |
| 5,001,313 | A | 3/1991 | Leclerq et al. | 218/76 |
| 5,004,878 | A | 4/1991 | Seymour et al. | 218/155 |
| 5,029,301 | A | 7/1991 | Nebon et al. | 335/16 |
| 5,030,804 | A | 7/1991 | Abri | 200/323 |
| 5,043,688 | A * | 8/1991 | Castonguay et al. | 335/172 |
| 5,057,655 | A | 10/1991 | Kersusan et al. | 218/76 |
| 5,077,627 | A | 12/1991 | Fraisse | 361/93.2 |
| 5,083,081 | A | 1/1992 | Barrault et al. | 324/126 |
| 5,095,183 | A | 3/1992 | Raphard et al. | 218/59 |
| 5,103,198 | A | 4/1992 | Morel et al. | 335/6 |
| 5,115,371 | A | 5/1992 | Tripodi | 361/106 |
| 5,120,921 | A | 6/1992 | DiMarco et al. | 200/401 |
| 5,132,865 | A | 7/1992 | Mertz et al. | 361/6 |
| 5,138,121 | A | 8/1992 | Streich et al. | 200/293 |
| 5,140,115 | A | 8/1992 | Morris | 200/308 |
| 5,153,802 | A | 10/1992 | Mertz et al. | 361/18 |
| 5,155,315 | A | 10/1992 | Malkin et al. | 218/3 |
| 5,166,483 | A | 11/1992 | Kersusan et al. | 218/71 |
| 5,172,087 | A | 12/1992 | Castonguay et al. | 335/160 |
| 5,178,504 | A | 1/1993 | Falchi | 411/553 |
| 5,184,717 | A | 2/1993 | Chou et al. | 200/401 |
| 5,187,339 | A | 2/1993 | Lissandrin | 218/84 |
| 5,198,956 | A | 3/1993 | Dvorak | 361/106 |
| 5,200,724 | A | 4/1993 | Gula et al. | 335/166 |
| 5,210,385 | A | 5/1993 | Morel et al. | 218/9 |
| 5,239,150 | A | 8/1993 | Bolongeat-Mobleu et al. | 218/84 |
| 5,260,533 | A | 11/1993 | Livesey et al. | 200/401 |
| 5,262,744 | A | 11/1993 | Arnold et al. | 335/8 |
| 5,280,144 | A | 1/1994 | Bolongeat-Mobleu et al. | 218/70 |
| 5,281,776 | A | 1/1994 | Morel et al. | 218/152 |
| 5,296,660 | A | 3/1994 | Morel et al. | 218/20 |
| 5,296,664 | A | 3/1994 | Crookston et al. | 200/401 |
| 5,298,874 | A | 3/1994 | Morel et al. | 335/8 |
| 5,300,907 | A | 4/1994 | Nereau et al. | 335/172 |
| 5,310,971 | A | 5/1994 | Vial et al. | 200/244 |
| 5,313,180 | A | 5/1994 | Vial et al. | 335/16 |
| 5,317,471 | A | 5/1994 | Izoard et al. | 361/105 |
| 5,331,500 | A | 7/1994 | Corcoles et al. | 361/93.3 |
| 5,334,808 | A | 8/1994 | Bur et al. | 200/50.21 |
| 5,341,191 | A | 8/1994 | Crookston et al. | 335/16 |
| 5,347,096 | A | 9/1994 | Bolongeat-Mobleu et al. | 218/84 |
| 5,347,097 | A | 9/1994 | Bolongeat-Mobleu et al. | 218/76 |
| 5,350,892 | A | 9/1994 | Rozier | 218/119 |
| 5,357,066 | A | 10/1994 | Morel et al. | 200/17 R |
| 5,357,068 | A | 10/1994 | Rozier | 218/44 |
| 5,357,394 | A | 10/1994 | Piney | 361/72 |
| 5,361,052 | A | 11/1994 | Ferullo et al. | 335/172 |
| 5,373,130 | A | 12/1994 | Barrault et al. | 218/30 |
| 5,379,013 | A | 1/1995 | Coudert | 335/17 |
| 5,424,701 | A | 6/1995 | Castonguary et al. | 335/172 |
| 5,438,176 | A | 8/1995 | Bonnardel et al. | 200/400 |
| 5,440,088 | A | 8/1995 | Coudert et al. | 200/303 |
| 5,449,871 | A | 9/1995 | Batteux et al. | 200/401 |
| 5,450,048 | A | 9/1995 | Leger et al. | 335/132 |
| 5,451,729 | A | 9/1995 | Onderka et al. | 200/18 |
| 5,457,295 | A | 10/1995 | Tanibe et al. | 200/293 |
| 5,467,069 | A | 11/1995 | Payet-Burin et al. | 335/42 |
| 5,469,121 | A | 11/1995 | Payet-Burin | 335/16 |
| 5,475,558 | A | 12/1995 | Barjonnet et al. | 361/64 |
| 5,477,016 | A | 12/1995 | Baginski et al. | 200/43.11 |
| 5,479,143 | A | 12/1995 | Payet-Burin | 335/202 |
| 5,483,212 | A | 1/1996 | Lankuttis et al. | 335/132 |
| 5,485,343 | A | 1/1996 | Santos et al. | 361/115 |
| D367,265 | S | 2/1996 | Yamagata et al. | D13/160 |
| 5,493,083 | A | 2/1996 | Olivier | 200/17 R |
| 5,504,284 | A | 4/1996 | Lazareth et al. | 200/50.01 |
| 5,504,290 | A | 4/1996 | Baginski et al. | 200/401 |
| 5,510,761 | A | 4/1996 | Boder et al. | 335/172 |
| 5,512,720 | A | 4/1996 | Coudert et al. | 200/400 |
| 5,515,018 | A | 5/1996 | DiMarco et al. | 335/16 |
| 5,519,561 | A | 5/1996 | Mrenna et al. | 361/105 |
| 5,534,674 | A | 7/1996 | Steffens | 218/154 |
| 5,534,832 | A | 7/1996 | Duchemin et al. | 335/16 |
| 5,534,835 | A | 7/1996 | McColloch et al. | 335/172 |
| 5,534,840 | A | 7/1996 | Cuingnet | 337/1 |
| 5,539,168 | A | 7/1996 | Linzenich | 200/303 |
| 5,543,595 | A | 8/1996 | Mader et al. | 200/401 |
| 5,552,755 | A | 9/1996 | Fello et al. | 335/18 |
| 5,581,219 | A | 12/1996 | Nozawa et al. | 335/132 |
| 5,604,656 | A | 2/1997 | Derrick et al. | 361/187 |
| 5,608,367 | A | 3/1997 | Zoller et al. | 335/132 |
| 5,784,233 | A | 7/1998 | Bastard et al. | 361/36 |
| 6,127,757 | A * | 3/2000 | Castonguay et al. | 335/6 |

* cited by examiner

CIRCUIT BREAKER ACCESSORY RESET SYSTEM

BACKGROUND OF THE INVENTION

The present invention relates to a circuit breaker accessory, and, more particularly, to a reset system for a circuit breaker accessory.

It is generally well known in the art of circuit breakers to provide a reset mechanism to reset a tripping device such as an accessory shunt trip or under voltage device. During quiescent operation, (i.e. when the circuit breaker contacts are closed to allow the flow of electrical current) the operating handle of an operating mechanism is in the "ON" position. To stop the current flow manually, the handle may be shifted to the "OFF" position thereby opening the electrical contacts. Upon attainment of a pre-determined condition (trip event), such as ground fault or overload, the operating mechanism of the circuit breaker will release the forces of the mechanism operating springs and release the operating handle to a tripped position between the "ON" position and the "OFF" position. Before the circuit breaker may be turned "ON", the operating mechanism must be manually reset. This is accomplished by rotating the operating handle beyond the "OFF" position against the bias of the operating mechanism springs, thereby locking the operating mechanism in position.

The same mechanical forces used to direct the operating mechanism from the tripped position to the reset position are used to reset any attached accessories, such as an electronic trip actuator, a shunt trip actuator, auxiliary switch accessory, bell alarm or other type of accessory unit. However, as accessories are generally separate components mounted proximate to the operating mechanism, positional variations at the interface of the accessory and the circuit breaker operating mechanism are possible due to manufacturing tolerances. These positional variations can effect the quantity of reset force translated to the accessory and the range of motion of the provided reset force.

BRIEF SUMMARY OF THE INVENTION

In an exemplary embodiment of the invention, an accessory includes a trip arm biased by a spring to pivot in a clockwise direction about a trip arm pivot. A latch is arranged to pivot about a latch pivot and has the trip arm acting on a latch surface on the latch to push the latch in a counter clockwise direction about the latch pivot. An electromechanical device is positioned in the accessory having a plunger that acts on the latch by pulling it such that it is holding with the trip arm. When a signal is provided to the electromechanical device, the plunger is moved allowing the trip arm, being pushed by the stored energy spring, push the latch out of the way and interface the operating mechanism. To reset the trip arm and the latch, a reset lever is arranged to pivot about the latch pivot. The reset lever is configured to interface the operating mechanism, and has a drive portion for interfacing the trip arm for resetting. Thus, when the operating mechanism is reset, a portion extending from an operating handle interfaces the reset lever causing it to pivot, wherein the drive portion interfaces the trip arm to drive the trip arm about the trip arm pivot into the latched and ready to operate position.

This invention has many advantages over the prior art, including but not limited to the ability to reduce the quantity of reset force required to reset the accessory and to provide positional tolerance with added reset over-travel within the accessory.

DETAILED DESCRIPTION OF THE INVENTION

Figure 1:
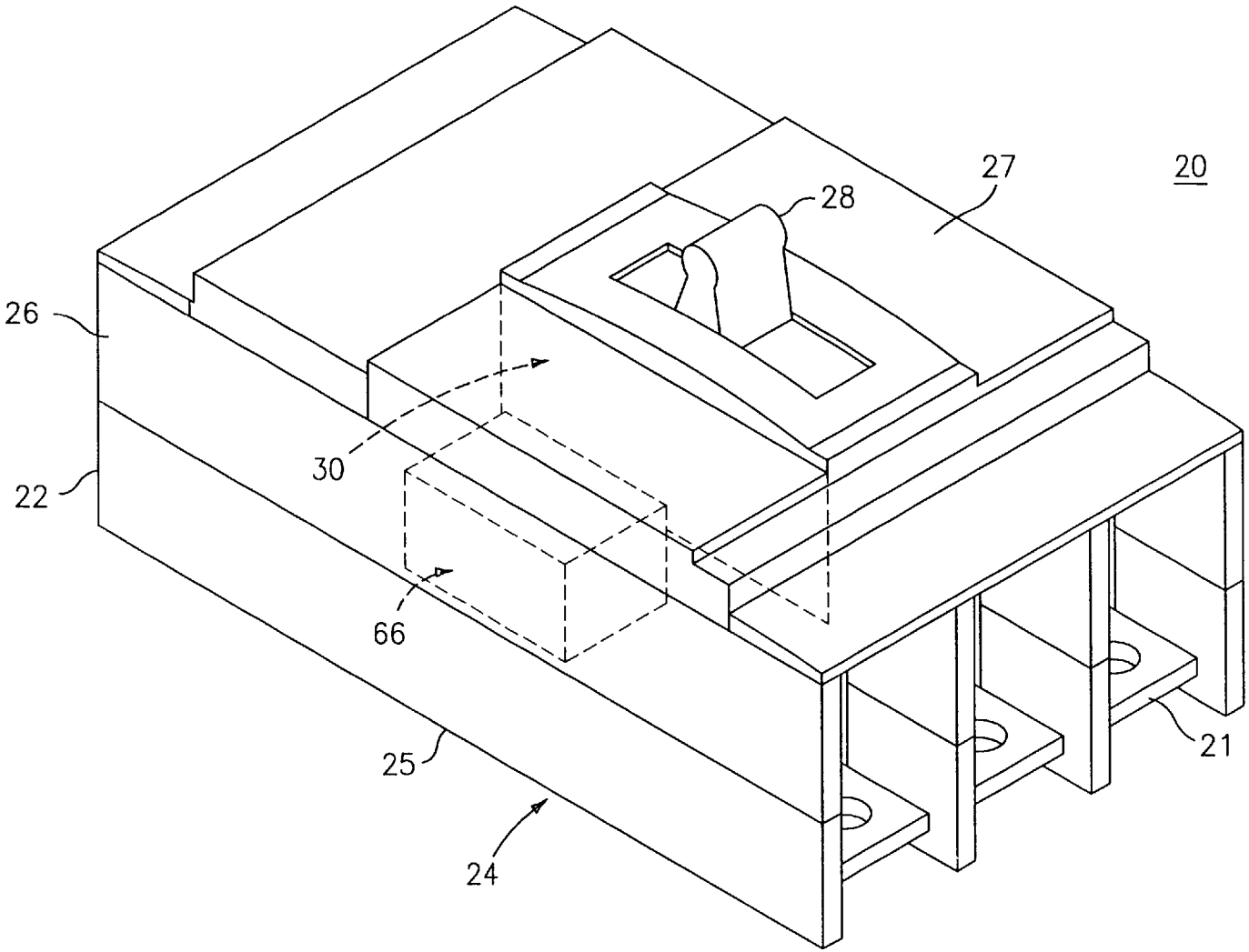
FIG. 1 is an isometric view of a circuit breaker.

A top perspective view of a molded case circuit breaker 20 is provided at FIG. 1. Molded case circuit breaker 20 is generally interconnected within a protected circuit between multiple phases of a power source (not shown) at line end 21 and a load to be protected (not shown) at load end 22. Molded case circuit breaker 20 includes a housing 24 with a base 25, a mid cover 26 and a top cover 27. An operating handle 28 passes through top cover 27 and interconnects with a circuit breaker operating mechanism 30. A trip actuator 66 is generally positioned and configured within mid cover 26 to interface operating mechanism 30.

Figure 2:
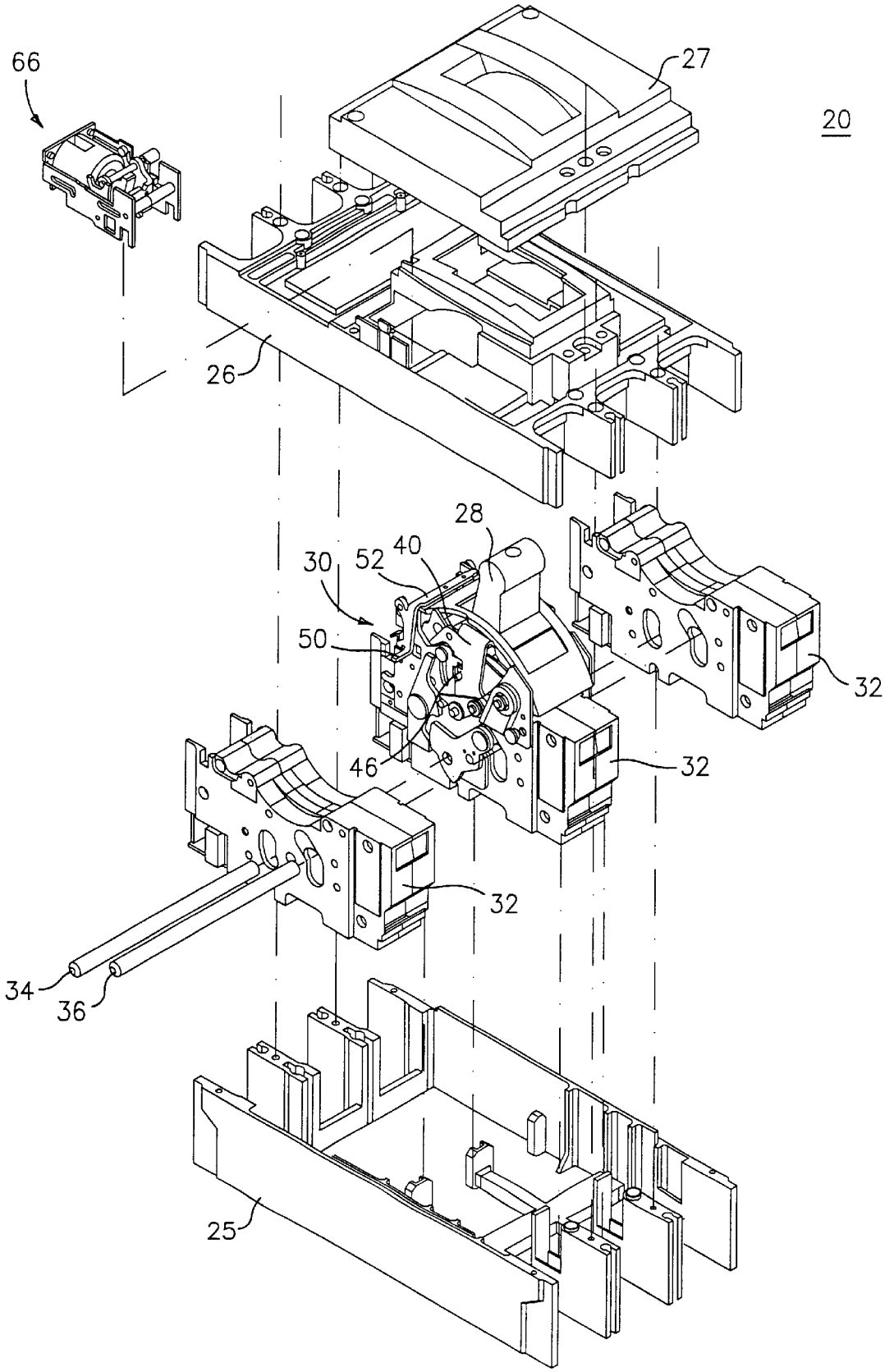
FIG. 2 is an exploded perspective view of a circuit breaker including a trip actuator of the present invention.

Referring now to FIG. 2, an exploded view of molded case circuit breaker 20 is provided. A series of circuit breaker cassettes 32 are generally well known and may contain, for example, a rotary type contact structure. Circuit breaker cassettes 32 are seated approximately upstanding within base 25, and one of the cassettes 32 includes operating mechanism 30 positioned thereon. One cassette 32 is provided for each phase of the electrical distribution circuit. Each cassette 32 includes one or more contact pairs therein for passage of current when the contacts are closed and for preventing passage of current when the contact pairs are opened. Each cassette 32 is commonly operated by a first bar 34 and a second bar 36 that interface with the internal mechanisms of cassettes 32 and with operating mechanism 30 such that operating mechanism 30 operates all cassettes 32. It is contemplated that the number of phases, or specific type of cassette utilized, can vary according to factors including, but not limited to, the type of load circuit being protected and the type of line input being provided to the circuit breaker 20.

Figure 3:
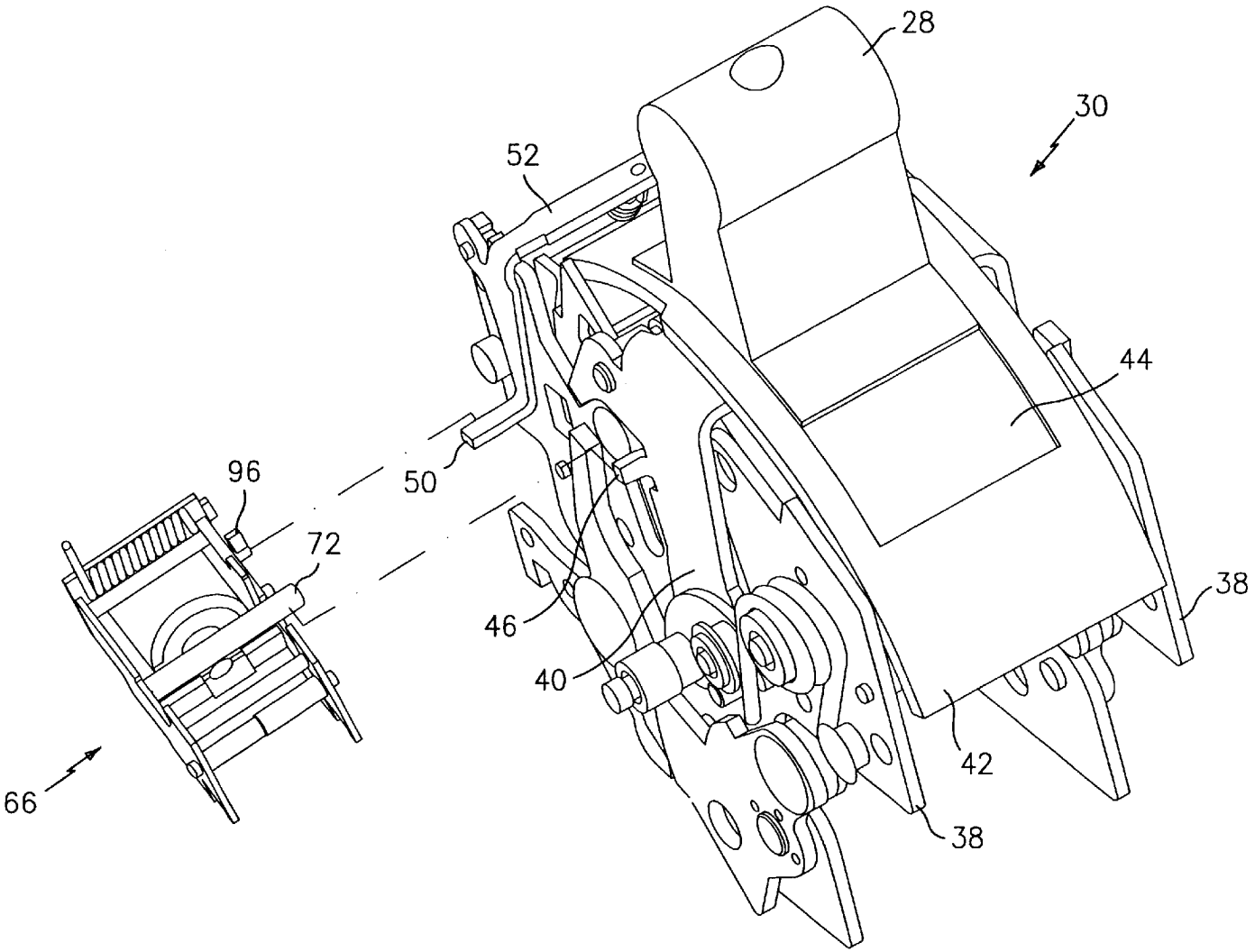
FIG. 3 is an isometric view of the trip actuator and operating mechanism of FIG. 2.

Referring to FIG. 3, circuit breaker operating mechanism 30 includes a frame 38 having spaced apart sidewalls. An operating handle-yoke 40 generally fits over frame 38.

Operating handle 28 is interconnected with operating handle-yoke 40. Operating mechanism 30 includes an operating mechanism cover 42 with a handle opening 44 formed therein allowing operating handle 28 to pass therethrough. Handle-yoke 40 includes a reset tab 46 depending generally perpendicularly therefrom to allow interface with trip actuator 66, and more specifically to interact with a reset tab 72 of trip actuator 66. Frame 38 includes a secondary latch 52 pivotally secured thereto. Secondary latch 52 includes a secondary latch tab 50 depending generally perpendicularly therefrom. Secondary latch tab 50 interfaces with a trip paddle 96 extending from trip actuator 66.

Upon assembly, trip actuator 66 is positioned such that the trip paddle 96 is adjacent to latch tab 50, and a reset tab 72 is adjacent to reset tab 46. This is generally accomplished by seating trip actuator 66 alongside operating mechanism 30 within mid cover 26 (FIGS. 1 and 2).

Figure 4:
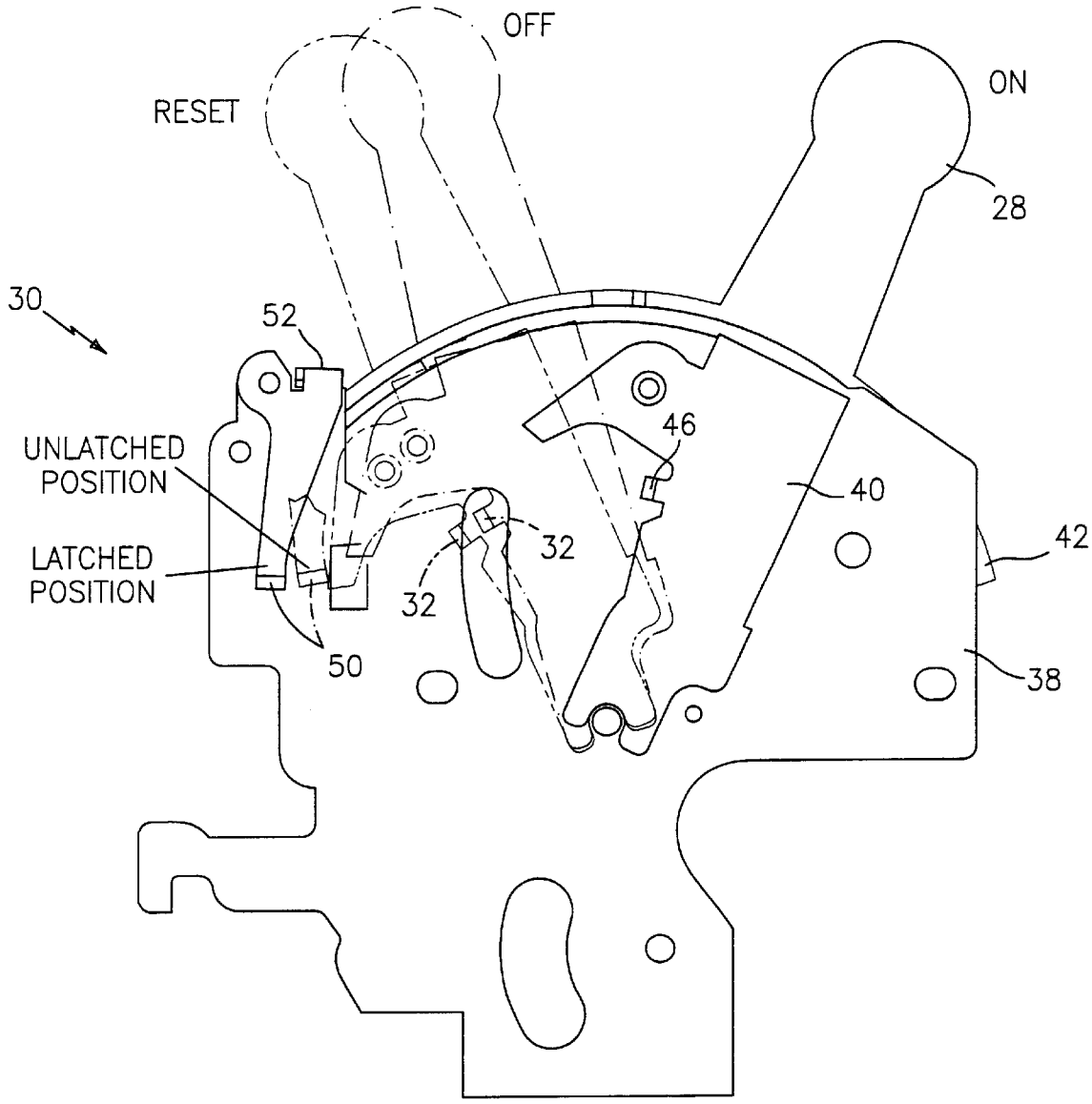
FIG. 4 is a side view depicting the general operation of the circuit breaker operating mechanism of FIG. 3.

Referring to FIGS. 3 and 4, the operation of the circuit breaker operating mechanism 30 will be generally described. FIG. 4 shows the operating mechanism 30 in three discrete positions: the "ON" position, the "OFF" position and the "RESET" position. Upon activation of trip actuator 66, trip paddle 96 will be displaced generally in a forward direction (toward reset tab 72) and will contact latch trip tab 50, displacing tab 50 from the "Latched" position to the "Unlatched" position as shown in FIG. 3. This will release latch 52 allowing operating mechanism 14 to move from the "ON" position to a "TRIPPED" position (not shown), opening the set of circuit breaker contacts (not shown). In the "TRIPPED" position, handle 28 is located between the "ON" and "OFF" positions shown. Before operating handle 28 may be returned to the quiescent operation position (i.e., "ON"), circuit breaker operating mechanism 30 and trip actuator 66 must be reset. This is accomplished by providing a reset force to operating handle 28 in the counter-clockwise direction against the bias of one or more springs (not shown) to the "RESET" position, thereby moving the secondary latch 52 of operating mechanism 30 from the "Unlatched" position to the "Latched" position. The reset force rotates operating handle 28 causing reset tab 46, to drive reset tab 72 towards trip paddle 96 and reset trip actuator 66, as will be described in further detail hereinafter. The reset force can be applied manually or with a charging mechanism (not shown).

Referring now to FIGS. 5–8, trip actuator 66 is shown. Trip actuator 66 includes a frame 100, an electromechanical device such as a flux shifter 102, a trip arm 104, a trip spring 106, a reset lever 108, a latch 110, and a bell alarm lever 152. Frame 100 includes a back wall 112 with two sidewalls 114, 116 depending substantially perpendicular therefrom. The sidewalls 114, 116 extend substantially parallel to each other, and are joined by a pair of frame pins 118, 119 that extend from side wall 114 to side wall 116. Frame 100 is preferably formed from a single plate of metal. A cover 160 is positioned generally atop frame 100, having a front portion 162 supported by frame pin 118 and a rear portion 164 arranged over back wall 112.

Trip arm 104 is hingedly secured to sidewalls 114, 116 by a trip arm pivot 120, which extends from side wall 114 to side wall 116. Trip arm 104 includes two hinge portions 122 which accept trip arm pivot 120, and a hinge support portion 124 that extends between hinge portions 122. Trip arm 104 also includes a latch portion 125 that extends downwardly from support portion 124 and along the outside of side wall 116. Latch portion 125 is configured with a cut out portion 123, which is generally provided to reduce the mass of trip arm 104. Trip paddle 96 depends substantially perpendicularly latch portion 125. A latch surface 126 is formed on an edge of latch portion 125 opposite trip paddle 96. An arcuate cam surface 127 is formed on an edge of latch portion 125 opposite reset tab 72. Trip arm 104 is preferably formed from a single plate of metal.

Figure 5:
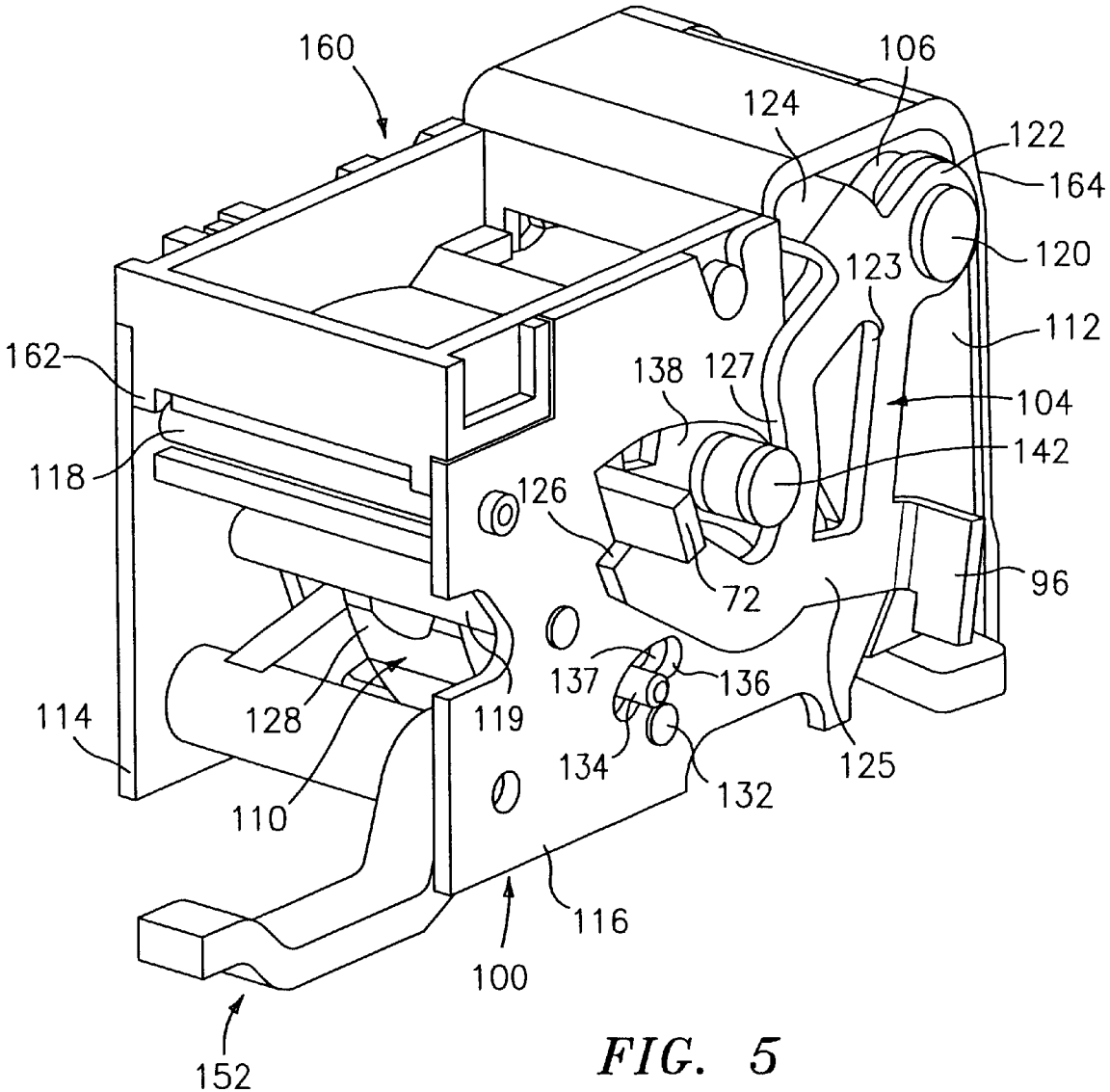
FIG. 5 is an isometric view of the trip actuator of FIG. 3 in a released discharged state.
Figure 6:
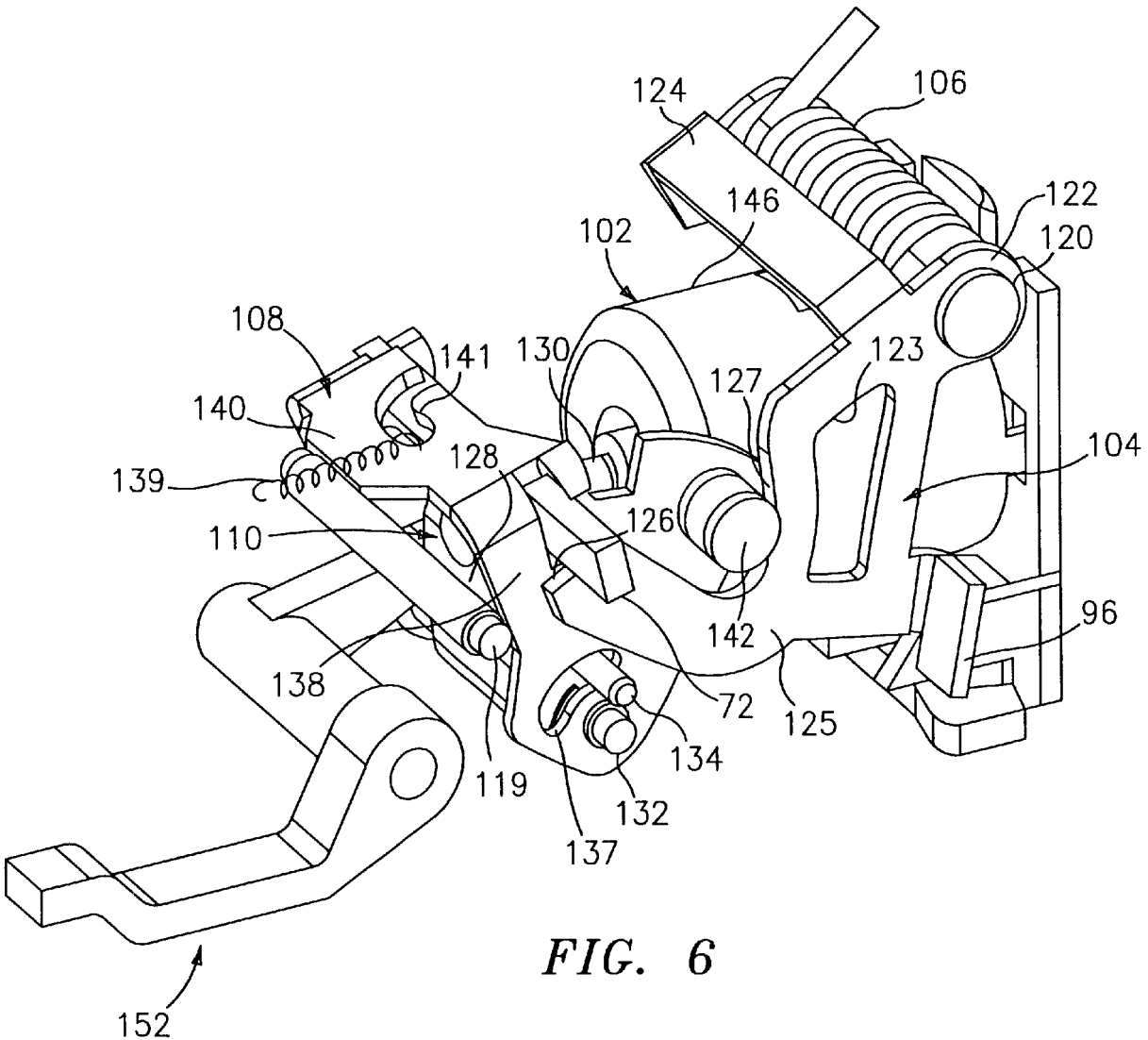
FIG. 6 is an isometric front view of the trip actuator of FIG. 3 in the released discharged state having its cover removed and its frame partially cut away.
Figure 7:
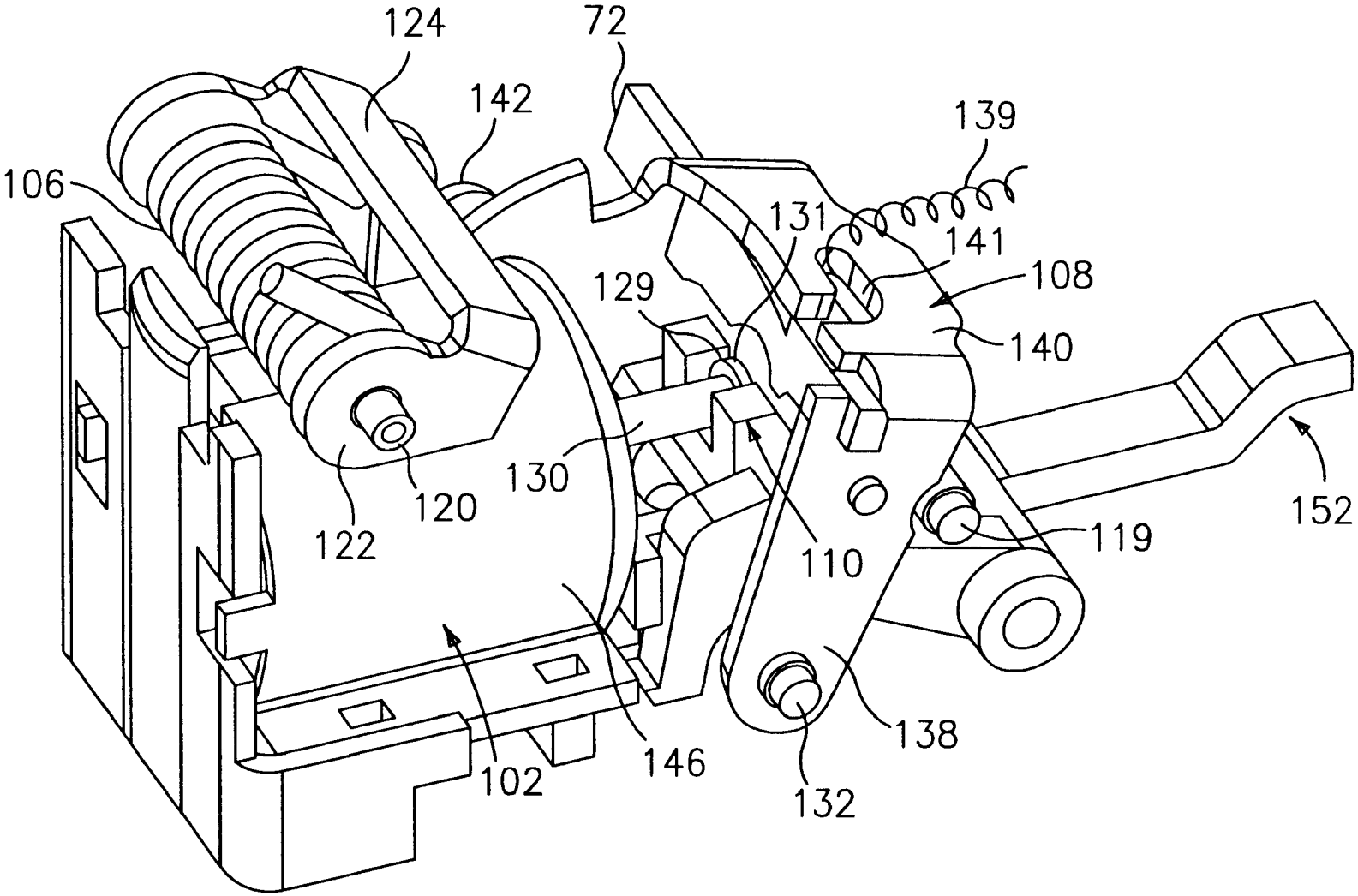
FIG. 7 is an isometric rear view of the trip actuator of FIG. 3 in the released discharged state having its cover removed and its frame partially cut-away.

Trip spring 106 is shown as a torsion spring disposed around trip arm pivot 120. One end of trip spring 106 is secured by back wall 112 of frame 100, while the other end is positioned beneath hinge support portion 124 of the trip arm 104. Trip spring 106 acts to bias trip arm 104 in the clockwise direction, as shown in FIG. 5.

Figure 8:
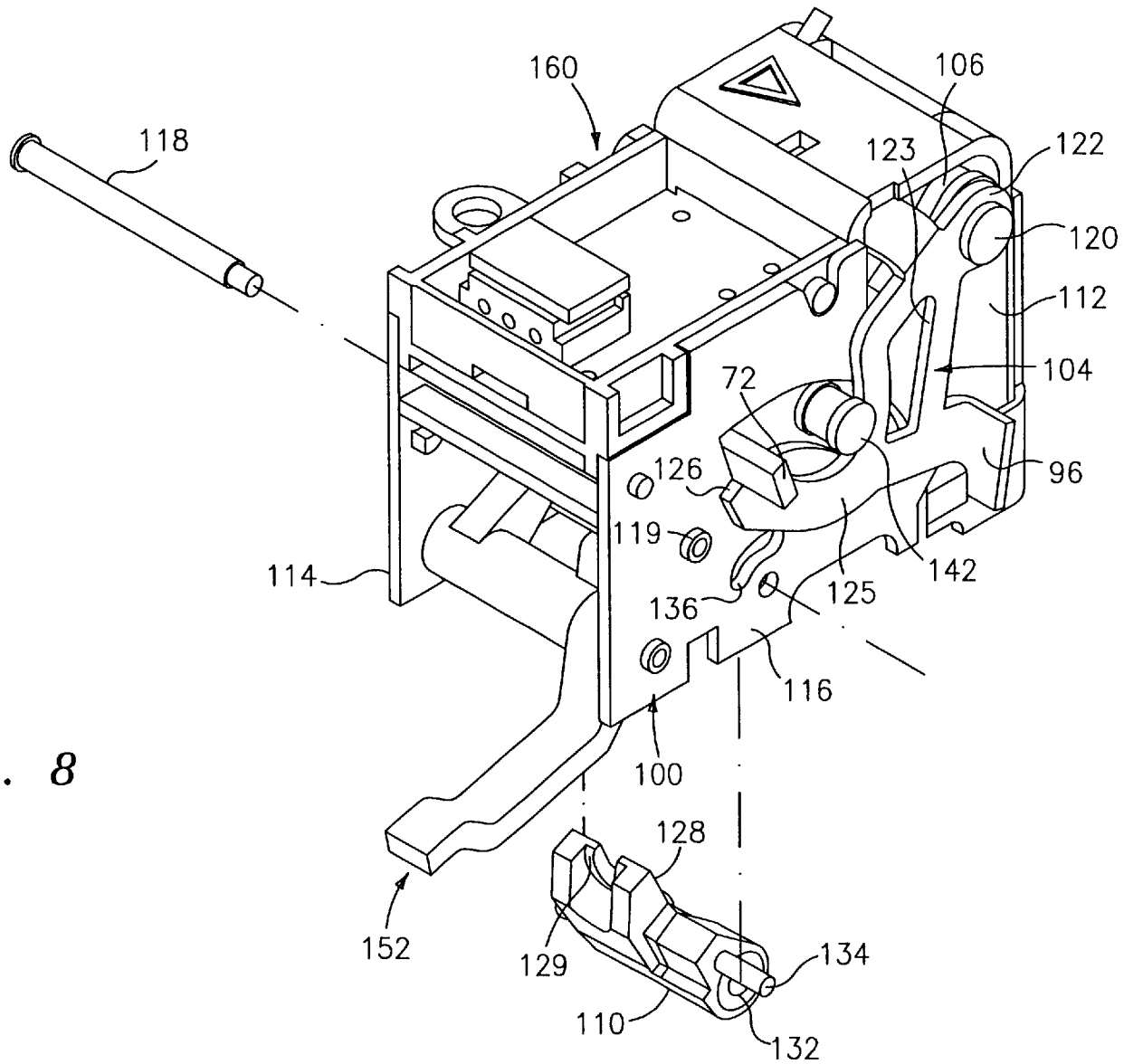
FIG. 8 is an isometric view of the trip actuator of FIG. 3 in a released discharged state having a latch removed from the frame.

Latch 110 is formed as a substantially solid shaft having a boss 128 disposed thereon. FIG. 8 shows latch 110 disasembled. A slot 129 formed in boss 128 accepts a head 131 of a plunger 130, which extends from flux shifter 102. The ends of latch 110 are pivotally secured to frame sidewalls 114 and 116 by a latch pivot 132. A latch pin 134 is secured to an end of latch 110, and extends from latch 110 through an arcuate slot 136 disposed in side wall 116. Latch pin 134 is arranged to interact with the latch surface 126 of trip arm 104 in a manner described hereinbelow. Bell alarm lever 152 is optionally connected to latch 110 to activate a bell alarm (not shown) when latch 110 is displaced.

Reset lever 108 includes side arms 138 that extend from a central support 140. Side arms 138 extend along side walls 114, 116 and are pivotally secured to side walls 114, 116 by latch pivot 132. Reset lever 108 is biased in the counter-clockwise direction about latch, pivot 132 due to a spring 139 having one end attached to a slot 141 in central support 140 and the other end attached to a portion (not shown) of cover 160 proximate to frame pin 118. Latch pin 134 extends through an arcuate slot 137 in one side arm 138. Reset tab 72 and a reset roller 142 depend substantially perpendicularly from a side arm 138 proximate side wall 116. Reset tab 72 and reset roller 142 extend through an arcuate slot 144 formed in sidewall 116. Slot 144 has an end 145 that is opposite a side 73 of reset tab 72. Reset roller 142 is positioned opposite arcuate cam surface 127 and is configured to roll on cam surface 127, for example, by being revolvably disposed on a pin (not shown) depending substantially perpendicularly from a side arm 138.

Flux shifter 102 is an electromechanical device mounted to rear wall 112 of the frame 100. The construction and operation of flux shifter 102 is known in the art and is similar in operation to that described in U.S. Pat. No. 5,453,724. Flux shifter 102 includes plunger 130, which slidably extends from a body 146. Plunger 130 is releasably secured by a magnet (not shown) within body 146. Flux shifter 102 is arranged to receive a triggering signal (e.g., a trip signal) from an electrical device (e.g., a trip unit). Upon receipt of the triggering signal, a coil (not shown) in the flux shifter 102 shunts out the magnet, and plunger 130 is released from the magnet. Once released by the magnet, plunger 130 is free to extend outward from body 146.

Figure 9:
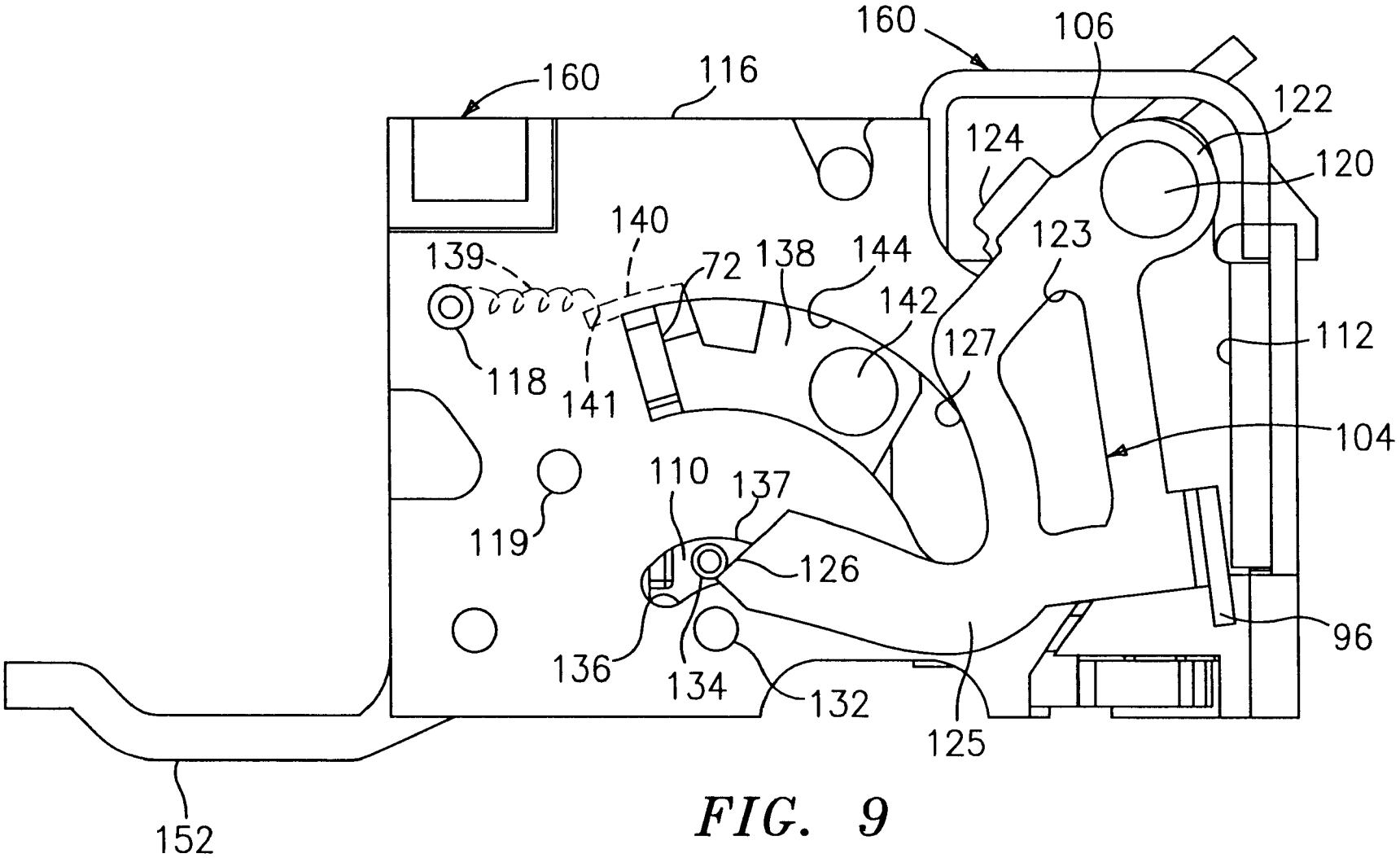
FIG. 9 is a side view of the trip actuator of FIG. 3 in a latched and ready to operate state.
Figure 10:
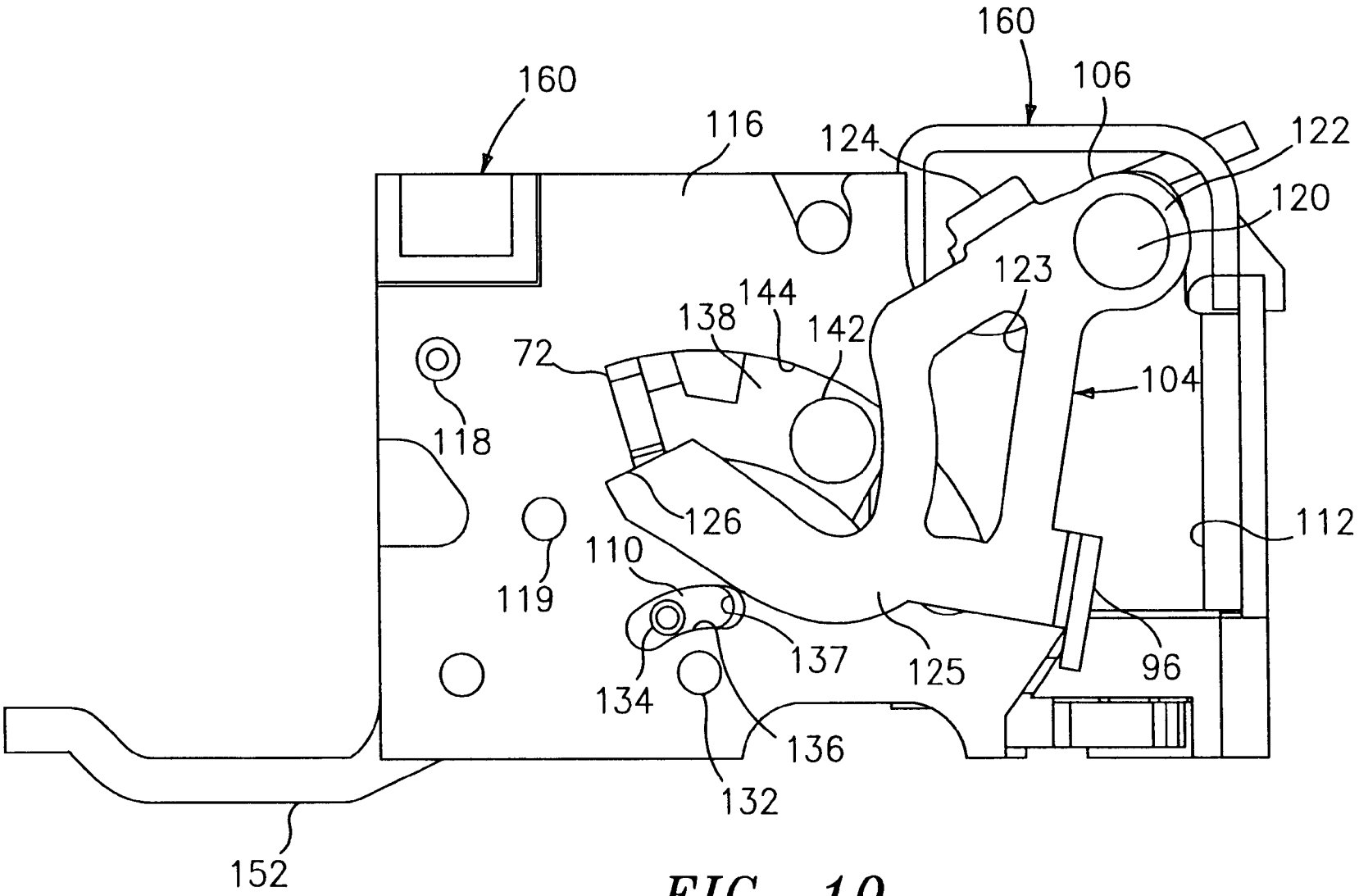
FIG. 10 is a side view of the trip actuator of FIG. 3 in a tripped released state.

Referring still to FIGS. 5–8, and also to FIGS. 9 and 10, trip and reset action of the trip actuator 66 will be described. FIG. 9 shows trip actuator 66 in a latched and ready to operate state. In this state, trip spring 106 is loaded to bias the trip arm 104 in a clockwise direction about trip arm pivot 120. Latch surface 126 of trip arm 104 acts with a force against latch pin 134 that creates a counterclockwise moment about the axis of latch pivot 132.

Latch 110 is held in an upright position by plunger 130, and plunger 130 is held in tension by a magnet (not shown) disposed in body 146 of flux shifter 102. A force of plunger 130 on the latch 110 creates a clockwise moment about the axis of latch pivot 132. In the latched and ready to operate state shown, the clockwise moment created by the plunger tension opposes the counterclockwise moment created by latch surface 126 against latch pin 134 and holds latch 110 in the upright position against the force of trip arm 104. The plunger tension acting on latch 110 can generally be much less than the force of trip arm 104 (due to spring 106) because of the relationship between the plunger tension, the clockwise moment and its respective moment arm (not shown), and the force of trip arm 104, the counterclockwise moment and its respective moment arm (not shown). This is described in greater detail in U.S. patent application Ser. No. 09/518,899 now U.S. Pat. No. 6,211,757.

When a trip (triggering) signal is provided to flux shifter 102, the coil (not shown) in flux shifter 102 shunts out the magnetic circuit, releasing plunger 130. With the plunger tension removed, trip arm 104 will drive latch pin 134, causing latch 110 to rotate counterclockwise about latch pivot 132. As latch 110 and trip arm 104 rotate about their respective pivots 132, 120, latch pin 134 slides off latch surface 126, fully releasing trip arm 104 and allowing trip paddle 96 to move towards and into contact with secondary latch tab 50. The rotation of latch 110 may also cause a lever, such as a bell alarm lever 152 to move and activate a bell alarm (not shown). Movement of secondary latch tab 50 trips operating mechanism 30, as described with reference to FIG. 4 hereinabove. Trip actuator 66 comes to rest in the tripped released state shown in FIG. 10, where latch 110 is prevented from rotating further in the counterclockwise direction by contact with frame pin 119 and trip arm 104 is prevented from rotating further in the clockwise direction by contact with reset tab 72. Note the movement of latch pin 134 within slot 136 in the counterclockwise direction (as viewed in FIGS. 8 and 9) due to the release of plunger tension (e.g., due to the deactivation of the magnet within flux shifter 102).

Figure 11:
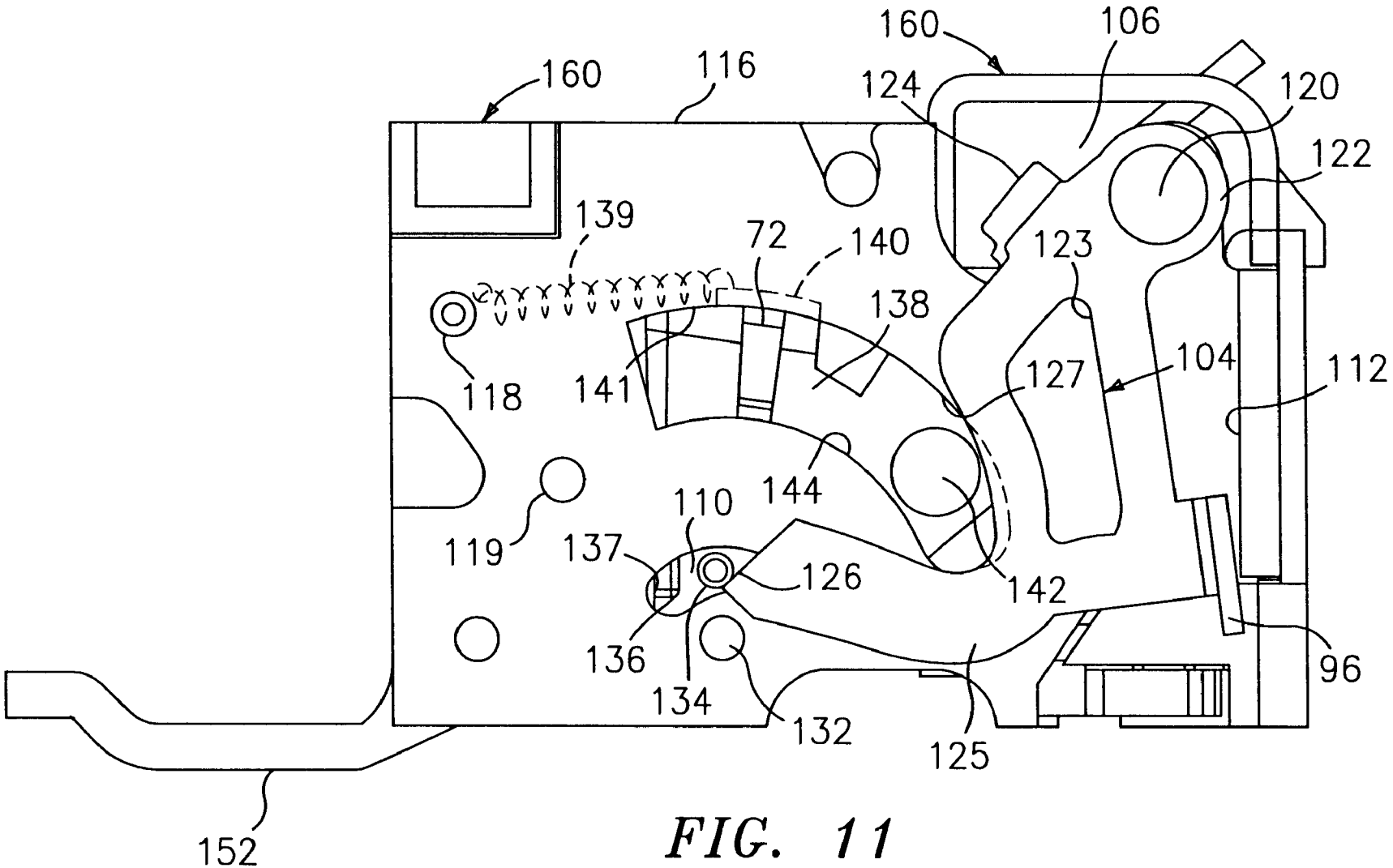
FIG. 11 is a side view of the trip actuator of FIG. 3 in a reset state.

Trip actuator 66 is reset (i.e. placed in the latched and ready to operate state of FIG. 6) by the application of reset force to operating handle 28. As operating handle 28 is rotated to the "RESET" position, as described with reference to FIG. 4, reset tab 46 of operating handle 28 pushes reset tab 72 of the trip actuator 66. This action causes reset lever 108 to pivot in a clockwise direction about latch pivot 132 against the bias of spring 139. The clockwise reset motion causes reset roller 142 to contact cam surface 127 of trip arm 104. This state (reset state) is shown in FIG. 11. (Also note the extension of spring 139 as compared to FIG. 9 where there is no reset force.

The driving force of roller 142 on cam surface 127 rotates trip arm 104 in the counterclockwise direction about pivot 120 against the bias of spring 106. Cam surface 127 and the geometries of trip arm 104 about its pivot 120, and reset lever 108 about its pivot 132 are configured to cause the multiplication of reset driving force applied by roller 142 as force is applied to reset tab 72. This configuration is generally an arcuate shaped cam surface 127. This results in a driving force that remains constant, or decreases, as reset force is applied to reset tab 72, even as spring 106 is further charged. Therefore, as reset force is applied, i.e., to operating handle 28, reset tab 46 pushes reset tab 72 until latch surface 126 is at or beyond latch pin 134. Latch pin 134 is at the position of FIG. 8 (i.e., the plunger tension has been reapplied). If the reset force is released, reset lever 108 will be pulled counterclockwise by spring 139 until side 73 of reset tab 72 is stopped by end 145 of slot 144. The engagement between latch pin 134 and latch surface 126 will hold trip arm 104 against the bias of spring 106, as described above in the latched state (FIG. 8).

Figure 12:
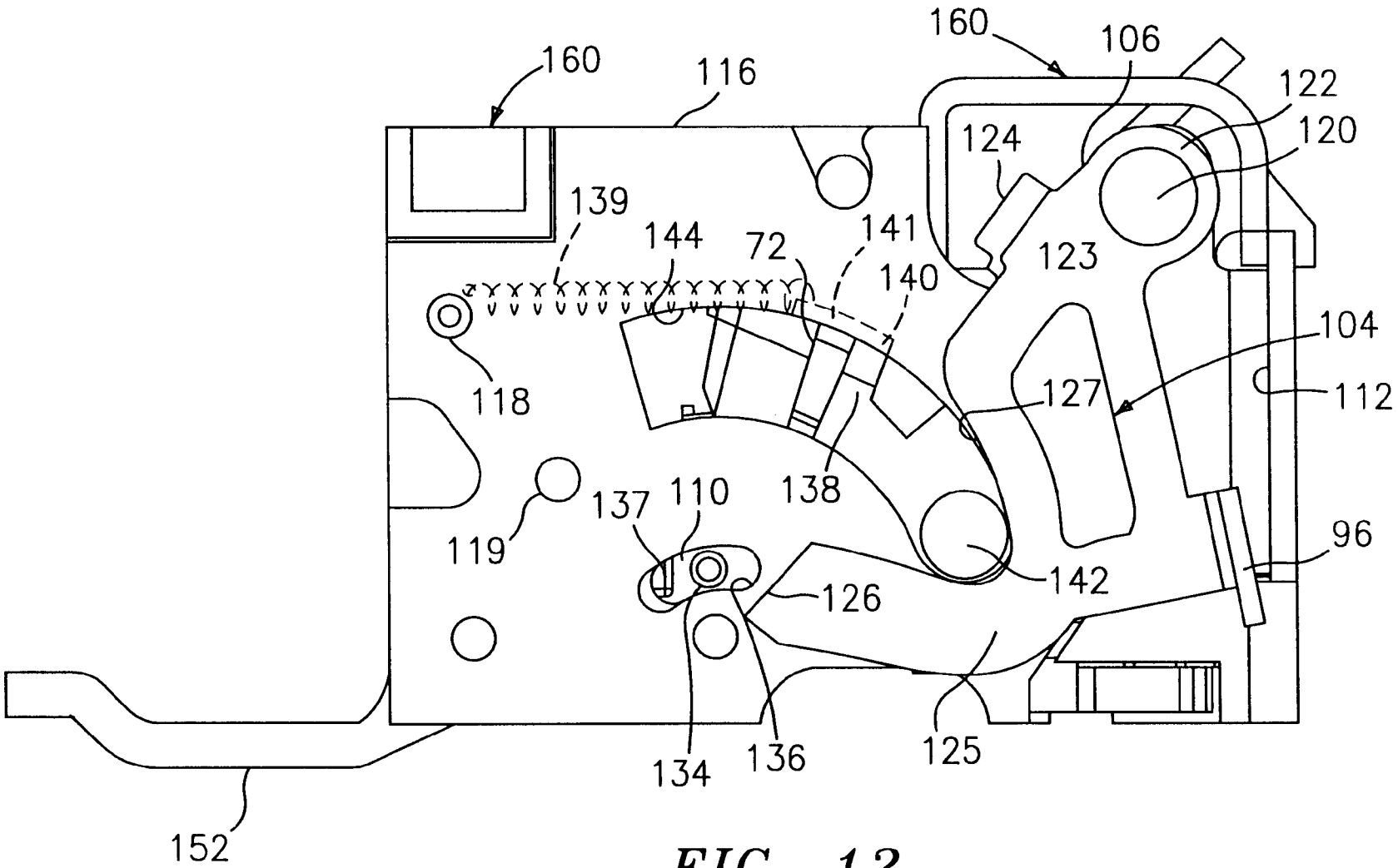
FIG. 12 is a side view of the trip actuator of FIG. 3 beyond the reset state.

If, on the other hand, and referring now to FIG. 12, reset force is continued when latch surface 126 is at or beyond latch pin 134 (i.e., beyond the reset state), roller 142 will continue to apply a driving force to trip arm 104 via cam surface 127. Due to the arcuate shape of cam surface 127, continued rotation of trip arm 104 is allowed. Also, due to the shape, the continued driving force by roller 142 will impart less rotation to trip arm 104 about pivot 120. This reduced rotation of trip arm 104 causes the driving force to be opposed by a constant or reduced bias of spring 106.

The shape of cam surface 127 allowing for decreased rotation of trip unit 104 about pivot 120 also results in a large amount of reset force over-travel, (e.g., operating handle 28 can be rotated to the reset position in FIG. 4 or further to the left) without imparting unwanted motion to other components (e.g., within trip unit 66, operating mechanism 30, or both). The release of reset force to operating handle 28 returns the system to the latched position as described hereinabove.

The reset system described herein allows for over-travel in the motion of the reset components with imparting unwanted motion. This over-travel allows for a more compliant interface between actuator 66 and operating mechanism 30. This is especially effective for overcoming tolerance variation in assembled components. Furthermore, by reducing the opposing force of spring 106 during application of reset force, the overall amount of reset force needed is decreased.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An accessory for interfacing an operating mechanism in a circuit breaker, the accessory comprising:

a trip arm biased to pivot in a first direction about a first axis;

a latch arranged to pivot about a second axis, said trip arm acting on said latch in a second direction about said second axis;

an electromechanical device including a plunger, said plunger acting on said latch in said first direction about said second axis;

a reset lever arranged to pivot about said second axis, said reset lever configured for interfacing said operating mechanism and for interfacing said trip arm;

wherein providing a signal to said electromechanical device releases said plunger to allow said trip arm to pivot in said first direction about said first axis and actuate the operating mechanism; and wherein resetting the operating mechanism interfaces said reset lever and pivots said reset lever in said first direction about said second axis, and interfacing said trip arm and pivoting said trip arm about said first axis in the second direction.

2. The accessory as in claim 1, said resetting of the operating mechanism accomplished by a reset force, said reset force transferring a drive force to said trip arm in said first direction about said second axis.

3. The accessory as in claim 2, wherein said trip arm includes a cam surface formed thereon for being contacted by said reset lever.

4. The accessory as in claim 3, wherein said cam surface is configured such said drive force does not increase when said reset lever travels in said first direction about said second axis.

5. The accessory as in claim 3, wherein said cam surface is configured such said drive force remains constant when said reset lever travels in said first direction about said second axis.

6. The accessory as in claim 3, wherein said cam surface is configured such said drive force does not increase when said reset lever travels in said first direction about said second axis.

7. The accessory as in claim 3, wherein said cam surface is arcuate, said drive portion acting on said cam surface such that said drive force when said reset lever commences pivot in said first direction about said second axis is the maximum drive force.

8. The accessory as in claim 1, further including:

a frame including first and second sidewalls, said trip arm being pivotally attached to said first sidewall at said first axis, said reset lever being pivotally attached to said first sidewall at said second axis, and said latch being pivotally attached to said first sidewall at said second axis.

9. The accessory as in claim 8, wherein said electromechanical device is mounted to said frame.

10. The accessory as in claim 8 wherein said trip arm includes a latch surface, further wherein said latch is pivotally attached to said first and second sidewalls at said first axis, an end of said latch proximate said first sidewall includes a latch pin extending therefrom, said latch surface acting on said latch pin, said latch further including a boss disposed thereon, said boss having a slot formed therein for accepting said plunger.

11. The accessory of claim 10, further comprising a first spring for providing a bias to said trip arm in said first direction about said first axis, wherein said trip arm includes:

first and second hinge portions, said first hinge portion being pivotally disposed to said first sidewall and said second hinge portion being pivotally attached to said second sidewall;

a support portion extending from said first hinge portion to said second hinge portion, said first spring providing said bias as said support portion; and a latch portion extending from said support portion and along said first sidewall, said latch portion including said latch surface formed thereon and a latch tab extending therefrom, said latch tab for actuating the operating mechanism.

12. The accessory as in claim 11, further wherein said reset lever includes a first side arm pivotally secured to said first sidewall at said second axis, a second side arm pivotally secured to said second sidewall at said second axis, a central support extending from said first sidearm to said second sidearm, and a second spring disposed between a slot on said central portion and a point supported by said frame, said second spring providing a bias to said reset lever in the second direction about said second pivot.

13. The accessory as in claim 12, wherein said first sidearm includes a drive portion disposed thereon configured for interfacing said trip arm, and said first sidearm further including a tab portion extending therefrom configured for being interfaced by said operating mechanism.

14. The accessory as in claim 13, wherein said drive portion is a low friction device.

15. The accessory as in claim 14, wherein said low friction device is a roller.

16. A circuit breaker for protecting a load from one or more predetermined conditions, the circuit breaker including:

a separable contact structure;

an operating mechanism arranged to separate said separable contact structure;

an operating handle interconnected to said operating mechanism; and a trip actuator arranged proximate said operating handle for actuating said operating mechanism, the trip actuator comprising:

a trip arm biased to pivot in a first direction about a first axis;

a latch arranged to pivot about a second axis, said trip arm acting on said latch in a second direction about said second axis;

an electromechanical device including a plunger, said plunger acting on said latch in said first direction about said second axis;

a reset lever arranged to pivot about said second axis, said reset lever having a tab portion for interfacing said operating handle and a drive portion for interfacing said trip arm;

wherein providing a signal to said electromechanical device upon occurrence said one or more predetermined conditions releases said plunger to allow said trip arm to pivot in said first direction about said first axis and actuate said operating mechanism; and wherein resetting said operating mechanism interfaces said tab portion to pivot said reset lever in said first direction about said second axis, and said drive portion interfacing said trip arm pivoting said trip arm against about said first axis in the second direction.

17. The circuit breaker as in claim 16, wherein said resetting of said operating mechanism is accomplished by a reset force, said reset force transferring a drive force to said trip arm in said first direction about said second axis.

18. The circuit breaker as in claim 17, wherein said trip arm includes a surface formed thereon for being contacted by said drive portion, said surface being configured such said drive force does not increase when said reset lever travels in said first direction about said second axis.

19. The circuit breaker as in claim 17, wherein said surface is arcuate, said drive portion acting on said surface such that said drive force when said reset lever commences it pivot motion in said first direction about said second axis is the maximum drive force.

20. A trip actuator for interfacing an operating mechanism in a circuit breaker, the trip actuator comprising:

a trip arm biased with a torsional spring to pivot in a first direction about a first axis, said trip arm having a reset surface;

a latch arranged to pivot about a second axis, said trip arm acting on said latch in a second direction about said second axis;

an electromechanical device including a plunger, said plunger acting on said latch in said first direction about said second axis;

a reset lever arranged to pivot about said second axis, said reset lever having a tab portion configured for interfacing said operating mechanism and a roller portion for interfacing said trip arm, and said reset lever biased in said second direction about said second axis;

wherein a reset force is applied to an operating handle on the operating mechanism causing a portion on said handle to interface said tab portion causing said reset lever to pivot in said first direction about said second axis, said reset lever transferring a drive force to said trip arm by the interface of said drive portion to said reset surface, said drive force pivoting said trip arm about said first axis in the second direction; and wherein said surface is an arcuate configuration such said drive force does not increase when said reset lever travels in said first direction about said second axis.

* * * * *